US007291065B2

(12) United States Patent
Lee

(10) Patent No.: US 7,291,065 B2
(45) Date of Patent: Nov. 6, 2007

(54) METHOD FOR CONTROLLING DIFFUSIVE GAME

(76) Inventor: Chiou-Haun Lee, No. 52, Dadun 7th Street, Taichung City (TW)

( * ) Notice: Subject to any disclaimer, the term of this patent is extended or adjusted under 35 U.S.C. 154(b) by 852 days.

(21) Appl. No.: 10/726,834

(22) Filed: Dec. 2, 2003

(65) Prior Publication Data

US 2005/0116412 A1 Jun. 2, 2005

(51) Int. Cl.
*A63F 9/08* (2006.01)

(52) U.S. Cl. ..... 463/9

(58) Field of Classification Search ..... 463/9, 463/14; 273/153 R, 156, 157 R, 153 S, 273/153 J See application file for complete search history.

(56) References Cited

U.S. PATENT DOCUMENTS 5,286,037 A * 2/1994 Ghaly ..... 463/9
5,296,845 A * 3/1994 Haller ..... 463/9
5,312,113 A * 5/1994 Ta-Hsien et al. ..... 463/9
5,643,084 A * 7/1997 Mirsky ..... 463/9
6,062,978 A * 5/2000 Martino et al. ..... 463/9
6,267,676 B1 * 7/2001 Nagaoka ..... 463/43
6,332,838 B1 * 12/2001 Yamagami ..... 463/9
6,458,032 B1 * 10/2002 Yamagami ..... 463/9
2003/0199293 A1 * 10/2003 Skripachev et al. ..... 463/9
2003/0232636 A1 * 12/2003 Ionescu ..... 463/9

* cited by examiner

*Primary Examiner*—Scott Jones
(74) *Attorney, Agent, or Firm*—Charles E. Baxley

(57) ABSTRACT

A diffusive game, comprising: a diffusive space having a plurality of regions; a plurality of variables for being put into the regions and producing actions in the regions. Each variable has an internal value, so that it has its own mode according to the internal value. A diffusive data processing unit performs a relational operation on the internal value of the variable in the diffusive space and the regions, and also produces diffusive operations. The method sets a region in the diffusive space as the triggering region and a specific action on a variable as the triggering action. When a player drives the variable to produce a triggering action, a diffusive data processing unit bases on the triggering region as the starting point to diffuse and transmit to each adjacent region according to the diffusive direction, and complete the diffusive and relational operation of the variable.

19 Claims, 6 Drawing Sheets

| | | | |
|---|---|---|---|
| First Target Region 121 | Second Target Region 122 | Third Target Region 123 | Fourth Target Region 124 |
| Triggering Region 12 | First Target Region 121 | Second Target Region 122 | Third Target Region 123 |
| First Target Region 121 | Second Target Region 122 | Third Target Region 123 | Fourth Target Region 124 |
| Second Target Region 122 | Third Target Region 123 | Fourth Target Region 124 | Fifth Target Region 125 |

FIG. 2

METHOD FOR CONTROLLING DIFFUSIVE GAME

FIELD OF THE INVENTION

The present invention relates to a method for controlling a diffusive game, more particularly to a diffusive space composed of a plurality of regions, each region having a variable with an internal value, so that a diffusive data processing unit performs a diffusion and relational operation on the regions adjacent to the triggered region in order to trigger and change the internal value of the variables.

BACKGROUND OF THE INVENTION

At present, there are many different educational and recreational games, such as the puzzle game, which fits a wide range of different age groups and becomes a favorite game to players because of its simple structure, simply game rules, easy-to-carry, easy-to-learn, easy-to-play, and highly educational and recreational features. Such educational and recreational games usually comprise a plurality of rectangular chesses of equal size being placed on a chessboard. The game rule requires the player to remove a piece of chess from the chessboard in order to spare a space and allow the rest of chesses to move transversally or longitudinally on the chessboard, such that all chesses can be finally rearranged into a sequential order to show a complete picture of the patterns printed on the chesses. Such game can also be comprised of chesses of different sizes, and the player moves the chesses transversally or longitudinally, such that a specific chess is located at a predetermined location. No matter which form the game takes, the game rule is fixed without too many variations. Perhaps, the game of this sort allows a little variation on the rearranged positions of the chesses, but after playing the game for a while, the player can memorize the solution of the puzzle, and the fun of playing such game will not last long.

In view of the shortcomings of the traditional game described above, the inventor of this invention focused on its problems and started thinking for an improvement to overcome such shortcomings and find a feasible solution. After extensive research and development, the inventor finally invented and designed the method of controlling diffusive games in accordance with this invention.

SUMMARY OF THE INVENTION

The primary objective of the present invention is to provide a method for controlling a diffusive game, which sets a region in a diffusive space as the triggering region and a specific action on a variable as the triggering action. When the player drives the variable to produce a triggering action, a diffusive data processing unit uses the triggering region as the starting point to diffuse and transmit to each adjacent region according to the diffusive directions, and complete the diffusion and relational operation of the variables. By means of a number of actions such as put-in, take-out, move, stack, or rotate each variable, the internal value of the rest variable around the triggering region is triggered to produce a diffusive operation. Such game allows more variations, and has many different solutions for the same game. The player can keep trying to solve the puzzle by many different methods, and thus maintaining the fun of the game for a long time.

The technical measures of this invention for solving the problem are described below:

A method for controlling diffusive game, comprising:

a diffusive space, being comprised of a plurality of regions divided into valid regions and invalid regions, and the game being played on the valid regions;

a plurality of variables, for being put into the regions and producing an action in the region; wherein the variable has an internal value, so that each variable has its different mode according to the internal value; and a diffusive data processing unit for performing a relational operation on the internal values of the variables in the diffusive space and the regions, and also producing a diffusive operation.

BRIEF DESCRIPTION OF THE DRAWINGS

FIG. 2 is an illustrative diagram of the diffusive space according to this invention.

DETAILED DESCRIPTION OF THE PREFERRED EMBODIMENTS

Figure 1:
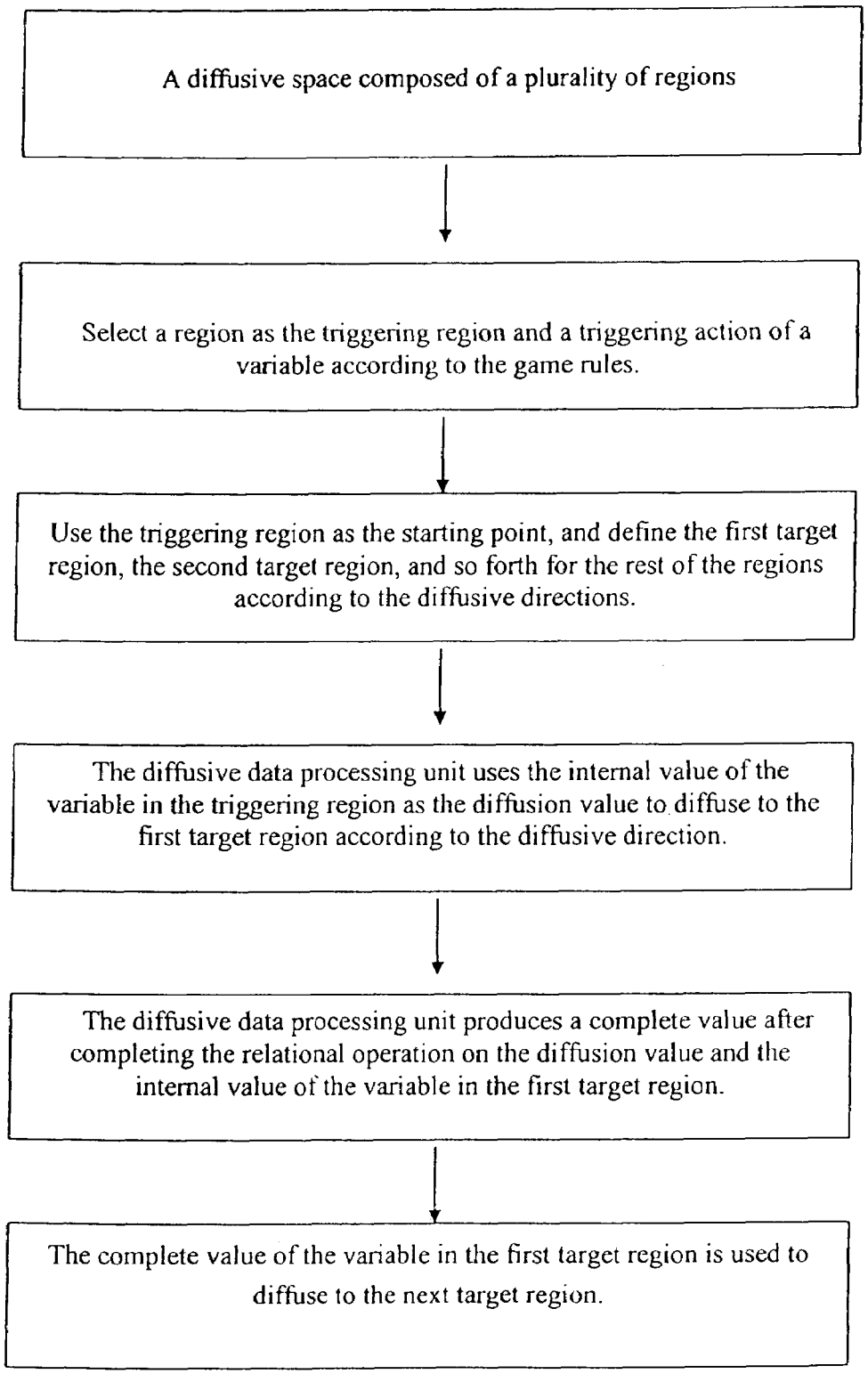
FIG. 1 is a flow chart of performing the triggering and diffusion according to this invention.

This invention discloses a method for controlling a diffusive game, which comprises:

a diffusive space (10), being comprised of a plurality of regions (11) divided into valid regions (111) and invalid regions (112), and the game being played on the valid regions (111);

a plurality of variables (20), for being put into the regions (11) of the diffusive space (10) and producing an action in the region (11); and such action including putting in, taking out, moving, and stacking; wherein the variable (20) has an internal value, so that each variable (20) has its own mode according to the internal value, and the variable (20) can change its indicating color, display pattern, or text to distinguish different modes; and a diffusive data processing unit (30) for performing a relational operation on the internal values of the variables (30) in the diffusive space (10) and the regions (11), and also produces diffusive operations, and the diffusive directions include horizontal, vertical, and diagonal directions.

Please refer to FIG. 2 for the example of a two-dimensional diffusive space (10) composed of 4×4 regions (11), and the diffusive data processing unit (30) follows the game rules to set a region (11) in the diffusive space (10) as the triggering region (12) and a specific action of the variable (20) as a triggering action.

If the player drives the variable (20) to produce a triggering action, the diffusive data processing unit (30) will set the triggering region (12) as the starting point. For example, the region (11) on the first column and second row from the upper left corner is set as the triggering region (12), and the rest of regions (11) are diffused into the first target region (121), the second target region (122), the third target region (123), the fourth target region (124), and the fifth target region (125) according to the diffusive direction, and the internal value of the variable (20) in the triggering region (12) is set as the diffusion value. The diffusive data processing unit (30) transmits the diffusion value to the first target region (121) according to the diffusive direction. If the variable (20) is stored in the first target region (121), the diffusive data processing unit (30) will perform a relational operation for the diffusion value with the internal value of the variable (20) in the first target region (121) to produce a complete value. Then the complete value of the variable (20) in the first target region (121) is set as the diffusion value and diffused and transmitted to the second target region (122) until the diffusive operations for all regions are completed. If the variable (20) is not placed into the region (11), the diffusion value of the region (11) is zero. If the region (11) is an invalid region, then no action on the variable (20) will be allowed in that region, but such region is still available for transmitting the diffusion. The diffusion value of that region is also zero. A player may repeatedly puts in, takes out, moves, or stacks the variables in the regions (11). After the diffusive data processing unit (30) is used to perform diffusive operations, the whole diffusive space (10) will produce a change with respect to the variables (20).

A preferred embodiment is described in detail as follows:

The internal values of the variable (20) include 0 and 1 to indicate different modes, and the change of color is used for example. If the internal value is 0, then the variable (20) is indicated by white color; if the internal value is 1, then the variable (20) is indicated by black color. If the relational operation by the diffusive data processing unit (30) is "Exclusive OR" Relation, then the result on the operation of 0 with 0 is 0; the result on the operation of 1 with 1 is 0; the result on the operation of 1 with 0 is 1; and the result on the operation of 0 with 1 is 1.

Figure 3A:
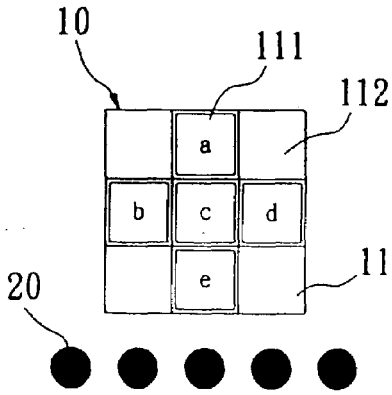
FIG. 3A is a planar diagram of the first preferred embodiment of this invention.
Figure 3B:
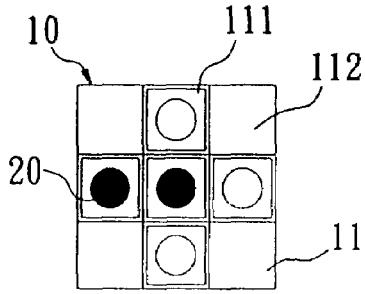
FIG. 3B is a diagram of the complete state of the first preferred embodiment of this invention.

Please refer to FIG. 3A for the example of a two-dimensional diffusive space (10) composed of 3×3 regions (11), wherein the middle five valid regions (111) define a cross-shaped space and five variables (20) with the internal value of 1 for the game. Each valid region (111) is defined as a, b, c, d, and e in sequence, and the variable (20) of each valid region (111) may have "Put-in" and "Take-out" actions, and the region of producing the "Put-in" action is set as the triggering region (12). If the change of (a, b, c, d, e)=(0, 1, 1, 0, 0) is made as shown in FIG. 3B, then the solution and action will be given as shown in FIGS. 4A to 4E.

Figure 4A:
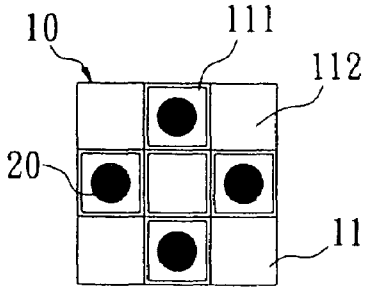
FIGS. 4A~4E are illustrative diagrams of the action process according to the first preferred embodiment of this invention.
Figure 4D:
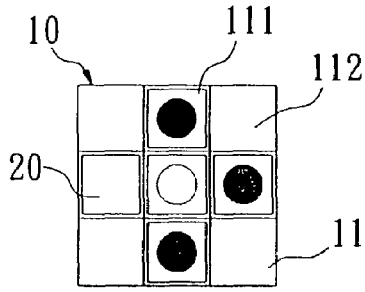
Figure 4B:
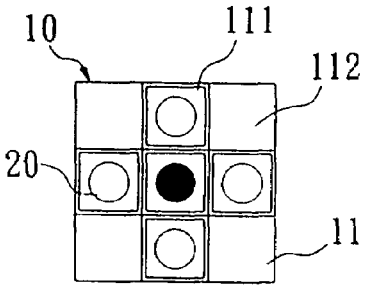
Figure 4E:
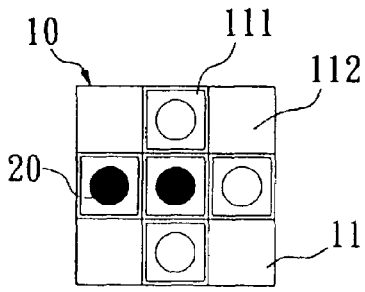
Figure 4C:
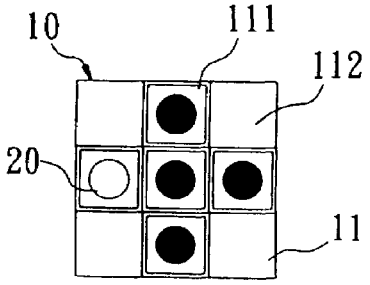

In FIG. 4A, the variables (20) with the internal value of 1 is put into a, b, d, and e, and then a variable (20) with the internal value of 1 is put into c. After the diffusive operation performed by the diffusive data processing unit (30), (a, b, c, d, e)=(0, 0, 1, 0, 0) as shown in FIG. 4B. The variable (20) with the internal value of 0 is taken out from b and then put in to b. After the diffusive operation is performed by the diffusive data processing unit (30), (a, b, c, d, e)=(1, 0, 1, 1, 1) as shown in FIG. 4C. The variable (20) with internal values 0 and 1 are taken out from b and c as shown in FIG. 4D, and the variable (20) with the internal value of 0 is put into c, and the variable (20) with the internal value of 1 is put into b. After the diffusive operation is performed by the diffusive data processing unit (30), (a, b, c, d, e)=(0, 1, 1, 0, 0) as shown in FIG. 4E, and then the goal of this game is accomplished.

Further, the region (11) of the diffusive space (10) restricts the "Put-in", "Take-out", "Move" and "Stack" actions produced by the variable (20) as the restriction conditions of the game. For example, when the variable (20) is put into the region (11), such variable (20) cannot produce the "Take-out" action anymore, or a variable (20) with a different internal value is put in advance into the region (11) which cannot produce the "Take-out" action in order to increase the level of difficulty and the fun of the game. Further, restrictions on the number of repeated triggering of each region or the distance of diffusion can be set. For example, different time for triggering the variables (20) can be used to determine the distance of the diffusion in order to define the method and goal of different games and further create new games.

Figure 5A:
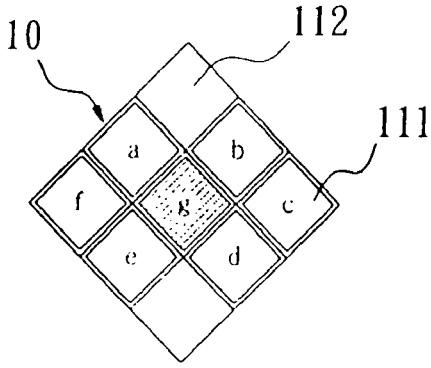
FIG. 5A is a planar diagram of the second preferred embodiment of this invention.
Figure 5D:
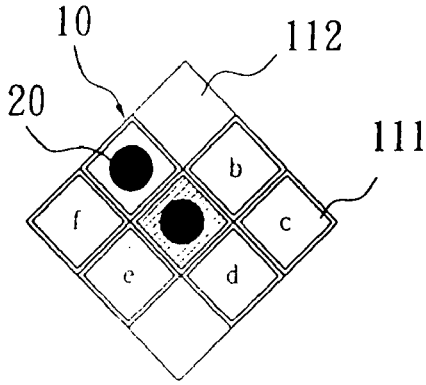
FIGS. 5B~5F are illustrative diagrams of the action process according to the second preferred embodiment of this invention.

Please refer to FIG. 5A for the example of a rhombus diffusive space composed of a plurality of 3×3 two-dimensional regions (11). Such diffusive space (10) is a dual rhombus space composed of 7 valid regions (111), and its diffusive direction is along the diagonal direction of the adjacent regions (11). The valid regions are defined as a, b, c, d, e, f and g in sequence. The variable of each valid region (111) can produce the "Put-in" and "Take-out" actions, and the game is played by taking turns between two players: Player A and Player B. The valid region (111) that finally produces the "Put-in" action by the player is set as the triggering region (12), wherein a, b, and c belong to Player A's territory and d, e, and f belong to Player B's territory. Both Players A and B have the equal number of variables (20), and a variable (20) is put into g randomly when the game starts, and g is the region (11) that cannot produce the "Take-out" action. If the mode of a variable (20) in the territory is changed, the variable (20) will be taken away by the territory owner. Players A and B are taking turns until the game reaches a predetermined time or round. The player having more variables (20) is the winner of the game.

Figure 5B:
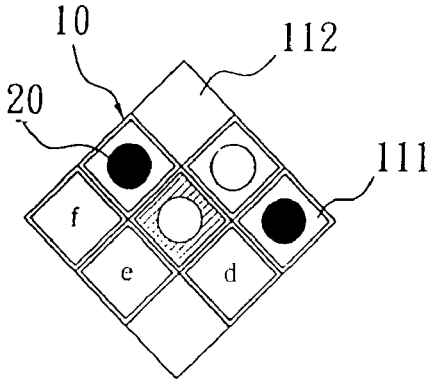
Figure 5E:
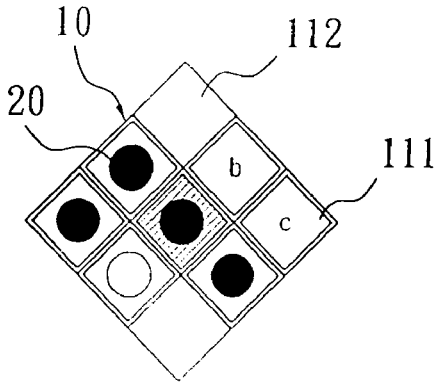
Figure 5C:
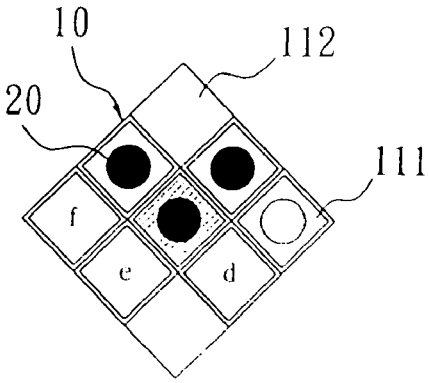
Figure 5F:
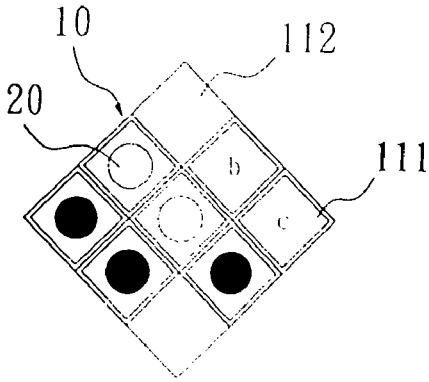

In FIG. 5B, the internal value in the variable (20) being randomly put into the valid region (111) g is 0, and Player A will put a variable (20) with internal value (1, 0, 1) into (a, b, c). The valid region (111) that produces the final "Put-in" action is a, and (a, b, c, g)=(1, 0, 1, 0) as shown in FIG. 5C. After the diffusive data processing unit (30) performs the diffusive operation, (a, b, c, g)=(1, 1, 0, 1). Player A takes away the variable (20) that causes a change to the territories b and c. In FIG. 5E, Player B puts in a variable (20) with the internal value (1, 0, 1) in (d, e, f), and the valid region (111) that finally produces the "Put-in" action is f, and (a, d, e, f, g)=(1, 1, 0, 1, 1) as shown in FIG. 5F. After the diffusive data processing unit (30) performs the diffusive operation, (a, d, e, f, g)=(1, 1, 1, 0). Player A takes away the variable (20) that has a change from the territory a, and Player B takes away the variable (20) that has a change from the territory e. Players A and B take turns until the predetermined time or round is reached, and by that time the game is ended, and the score will be counted.

Further, the diffusive space (40) of this invention could be composed of a three-dimensional region (41), and its diffusive directions also include a synchronous deep longitudinal direction, in addition to the horizontal, vertical, and diagonal directions. The actions for each variable (50) also include a relative rotation between variables (50) in addition to the "Put-in", "Take-out", "Move", and "Stack" actions. Several variables (50) can also be combined into a variable (51), and such combined variable (51) can be used for playing the game.

Figure 6A:
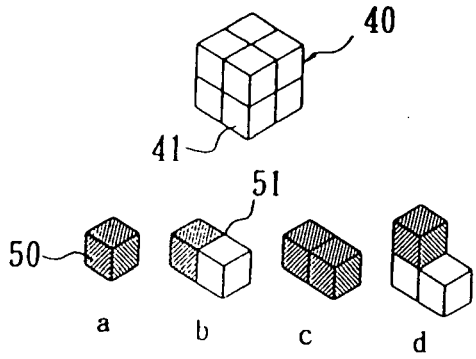
FIGS. 6A~6D are illustrative diagrams of the action process according to the third preferred embodiment of this invention.
Figure 6B:
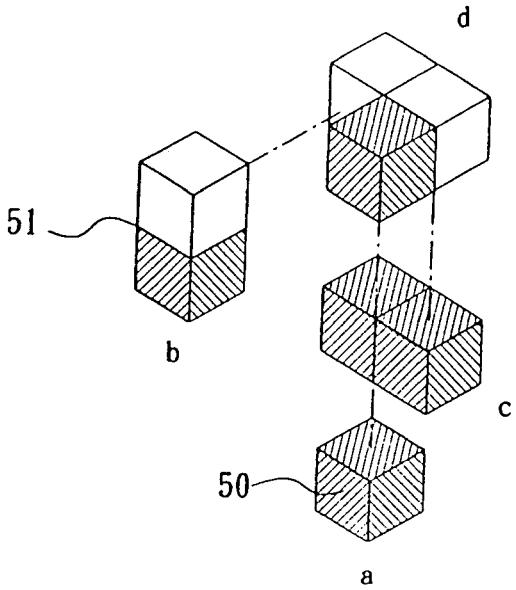
Figure 6C:
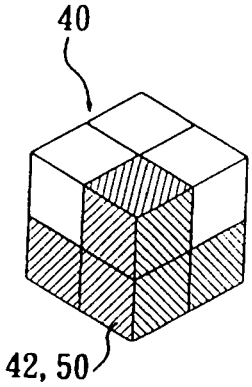
Figure 6D:
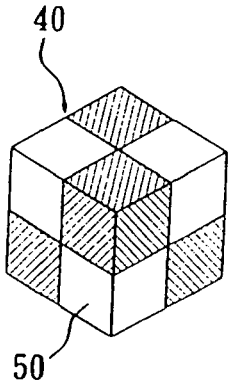

Please refer to FIG. 6A for a three-dimensional diffusive space (40) composed of 2×2×2 regions (41), and the variables (51) a, b, c and d are used for playing the game; wherein the variable (51) a is composed of a variable (50) having the internal value of 1, the variable (51) b is composed of two variables (50) having the internal values of 0 and 1, the variable (51) c is composed of two variables (50) having the internal values of 1, and the variable (51) d is a L-shaped variable (51) composed of three variables (50) having the internal values of (0, 0, 1) respectively, and the variable (51) in each region (41) can produce the "Put-in" and "Take-out" actions. The region (41) for the variable (51) a to produce the "Put-in" action is set as the triggering region (42), and the variable (51) a will change its internal value when the "Put-in" action is produced.

Figure 7A:
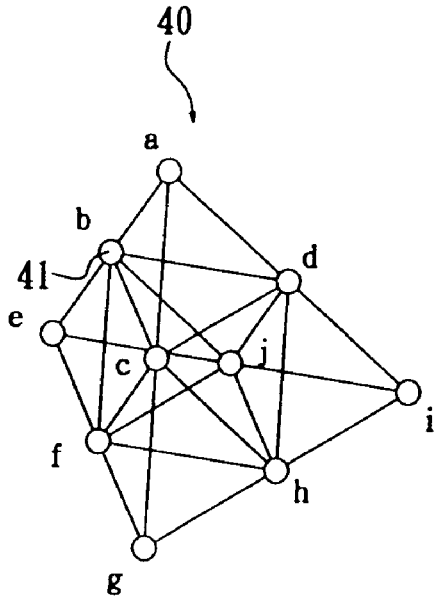
FIGS. 7A~7D are illustrative diagrams of the action process according to the fourth preferred embodiment of this invention.
Figure 7C:
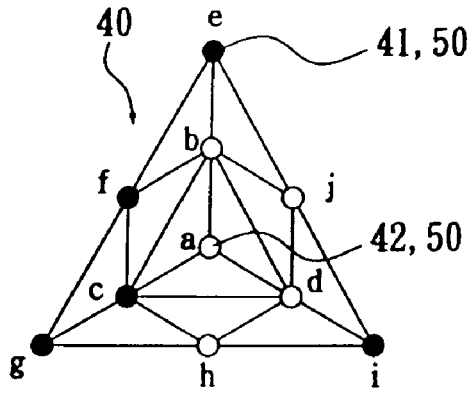

Further, please refer to FIG. 7A for the diffusive space (40) composed of triangular tetrahedrons. The region (41) of the first layer at the top is defined as a; the region (41) of the second layer is defined as b, c, d; the region (41) of the third layer is defined as e, f, g, h, i, j; the relative rotation produced by the variable (50) of each region (41) is set as the triggering action; and the region (41) at the top of the rotary axis is set as the triggering region (42).

Figure 7B:
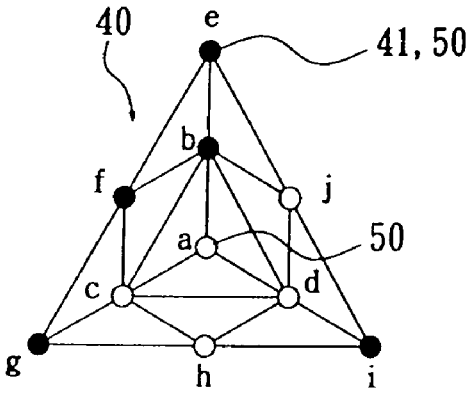
Figure 7D:
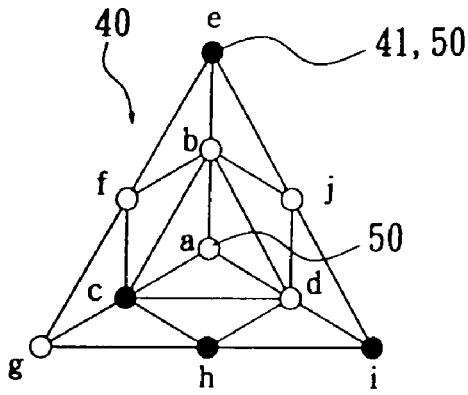

In FIG. 7B, the internal values of the variables in the regions (41) a, b, c, d, e, f, g, h, I, and j are (0, 1, 0, 0, 1, 1, 1, 1, 0) respectively. If a player uses the region (41) a as the top of the rotary axis and rotates the variables in the regions b, c, and d in the second layer counterclockwise to a certain angle, then the internal values of the variables (50) in the regions (41) b, c, and d are 0, 1, 0 respectively. After the diffusive data processing unit (60) sets the region (41) a as the triggering area (42) for the diffusive operation, the screen will appear as shown in FIG. 7D.

The player can use different vertexes of the triangular tetrahedron as the top of the rotary axis, and rotates the variables (50) in the regions (41) on the second or third layer clockwise or counterclockwise to a certain angle, so that each variable (50) in the diffusive space (40) of the triangular tetrahedrons produces different changes.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claim is:

1. A method for controlling diffusive game, comprising:

a diffusive space, being comprised of a plurality of regions divided into valid regions and invalid regions, and a game being played on said valid regions;

a plurality of variables, for being put into said regions and producing an action in said region; wherein the variable having an internal value, so that each variable having its different mode according to said internal value;

a diffusive data processing unit for performing a relational operation on the internal values of the variables of said diffusive space and said regions, and also producing diffusive operations; and said method for controlling diffusive game setting one of said diffusive spaces as the triggering region, and a specific action of said variable as the triggering action; thereby if a player driving said variable to produce a triggering action, then said diffusive data processing unit using said triggering region as the starting point to diffusive to each adjacent areas in the diffusive direction, and completing the diffusion and relational operation of each variable.

2. The method for controlling diffusive game of claim 1, wherein said relational operation is one selected from the group of "Exclusive OR" Relation.

3. The method for controlling diffusive game of claim 1, wherein said diffusive directions comprises horizontal, vertical, and diagonal directions.

4. The method for controlling diffusive game of claim 3, wherein said internal value of said variable is converted into a complete value after said relational operation of said variable in the regions is completed, and then said diffusive data processing unit uses said complete value as the diffusion value to diffuse in the diffusive direction towards the adjacent regions.

5. The method for controlling diffusive game of claim 3, wherein said region with no variable put in yet has a diffusion value of zero.

6. The method for controlling diffusive game of claim 3, wherein said invalid region has a diffusion value of zero.

7. The method for controlling diffusive game of claim 1, wherein said valid region is capable of restricting the number of triggering the diffusion.

8. The method for controlling diffusive game of claim 1, wherein said valid region is capable of restricting the distance of the diffusion.

9. The method for controlling diffusive game of claim 1, wherein said valid region is capable of restricting the action produced by said variables.

10. The method for controlling diffusive game of claim 1, wherein said variable comprises two modes.

11. The method for controlling diffusive game of claim 10, wherein said variable is capable of changing the color of display to distinguish different modes.

12. The method for controlling diffusive game of claim 10, wherein said variable is capable of changing the pattern of display to distinguish different modes.

13. The method for controlling diffusive game of claim 10, wherein said variable is capable of changing the text of display to distinguish different modes.

14. The method for controlling diffusive game of claim 1, wherein said diffusive space is a two-dimensional plane.

15. The method for controlling diffusive game of claim 14, wherein said variable in said diffusive space comprises the actions of put-in, take-out, move, and stack.

16. The method for controlling diffusive game of claim 1, wherein said diffusive space is a three-dimensional space.

17. The method for controlling diffusive game of claim 16, wherein said diffusive directions comprise horizontal, vertical, diagonal, and deep longitudinal directions.

18. The method for controlling diffusive game of claim 16, wherein said variable in said diffusive space comprises the actions of put-in, take-out, move, stack, and rotate.

19. The method for controlling diffusive game of claim 16, further comprising a variable composed of a plurality of adjacent variables.

* * * * *